United States Patent [19]

Breck, Jr.

[11] Patent Number: 4,467,737

[45] Date of Patent: Aug. 28, 1984

[54] PROGRAMMABLE SEWING MACHINE

[76] Inventor: Louis W. Breck, Jr., 8 Joe Turner Ct., El Paso, Tex. 79915

[21] Appl. No.: 557,900

[22] Filed: Dec. 5, 1983

[51] Int. Cl.[3] ..... D05B 3/02

[52] U.S. Cl. ..... 112/121.14; 112/121.15; 112/220; 112/309

[58] Field of Search ..... 112/121.14, 121.15, 112/121.11, 121.12, 308, 309, 220

[56] References Cited

U.S. PATENT DOCUMENTS

| | | | |
|---|---|---|---|
| 2,853,967 | 9/1958 | Schwab | 112/275 |
| 2,864,327 | 12/1958 | Cole et al. | 112/121.14 |
| 3,080,836 | 3/1963 | Clemens et al. | 112/308 X |
| 3,472,187 | 10/1969 | Kaplan et al. | 112/309 |
| 3,765,349 | 10/1973 | Gerber | 112/121.14 |

FOREIGN PATENT DOCUMENTS

| | | | |
|---|---|---|---|
| 781233 | 11/1980 | U.S.S.R. | 112/121.14 |

*Primary Examiner*—H. Hampton Hunter
*Attorney, Agent, or Firm*—Fred A. Keire

[57] ABSTRACT

A sewing machine device comprises a base, a platform elevated above the base, and a stitching head assembly suspended from the platform. The stitching head assembly includes a frame, a needle bar mounted for reciprocal movement, a clamp eye having an opening through which the needle passes and mounted for vertical reciprocal movement relative to the frame, and a thread take-up member mounted on the frame for relative movement towards and away from the needle eye. A stitching drive mechanism is mounted on a platform and imparts reciprocating motion to the needle bar, clamp eye, and thread take up. This mechanism includes a main shaft providing rotary drive motion and a drive head for transforming the rotary motion to reciprocating motion. A rotary sewing hook is mounted on a hook shaft journalled in the frame. A suspending bar is pivotally attached to the platform and journals the hook shaft a predetermined distance below the platform. A timing belt or other similar mechanism couples the main shaft and the hook shaft so that the latter rotates synchronously with the main shaft. A flexible drive and support mechanism, for example, a plurality of housed cables, suspends the stitching head a predetermined distance below the platform and transmits the reciprocating motion from the driving head to the needle bar, the clamp eye, and the thread take up. X and Y driving mechanisms, which can be programmed, move the stitching head, relative to the base, through a stitching pattern in two dimensions.

12 Claims, 1 Drawing Figure

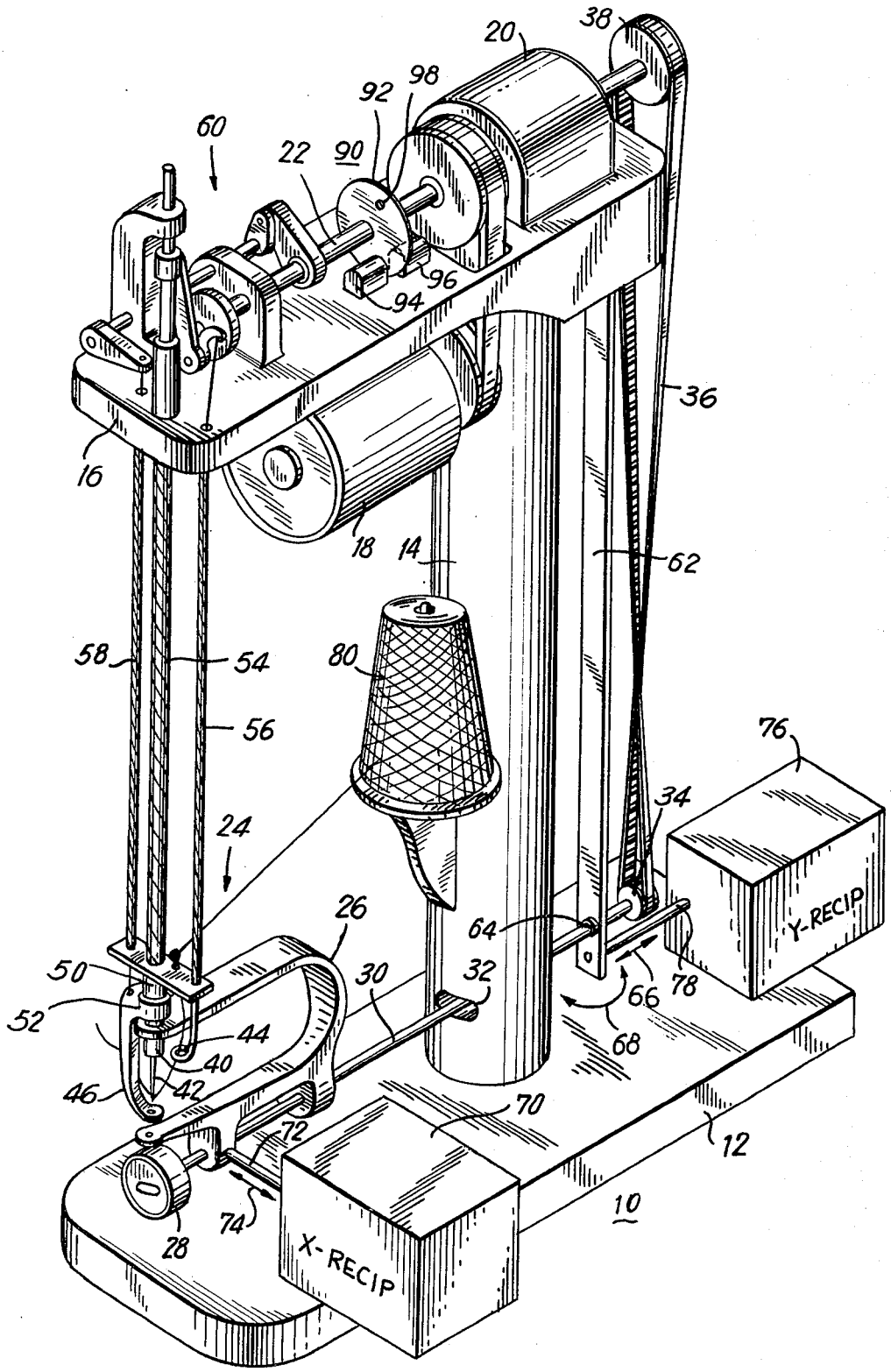
20
38
92
98
60
22
90
96
94
36
16
18
14
62
58
54
80
56
76
34
24
26
64
Y-RECIP
50
30
32
66
78
52
44
68
40
46
42
70
72
12
74
10
28
X-RECIP

PROGRAMMABLE SEWING MACHINE

The present invention relates to sewing machines, and especially sewing machines capable of carrying out automatic or semiautomatic sewing operations. The present invention is more particularly directed to a sewing apparatus for applying a programmed pattern of stitches to fabric articles by moving a low-inertia stitching device in two dimensions while holding a workpiece stationary.

In an industrial sewing operation, as in any sewing operation, it is required to provide relative transverse motion between the fabric articles or other workpiece and the sewing needle. This transverse motion is then controlled or programmed to produce a desired pattern of stitches.

In a conventional sewing machine, this relative transverse motion is provided by a feed dog, which is operative to advance the fabric workpiece by a predetermined distance between successive stitches. The operator guides the workpiece to produce a row of stitches in the desired location. In other types of sewing machines, for example in the type generally known as a "tacker", the stitch pattern is programmed by a cam or other similar means. Once the workpiece is loaded into the machine and the cycle is started, the workpiece is guided through its desired pattern without operator intervention.

In both of the above conventional types of sewing machine, the point of needle penetration is tranversely fixed and the workpiece must be moved relative to it, and to the machine frame, to produce the desired stitch pattern.

The conventional types of stitching operations, as discussed above, encounter special problems in industrial sewing operations, where high production rates, low operator skill levels, and adaptability to automation must be considered.

One of the most serious such problems surfaces when the industrial sewing operation is automated, because automated systems typically involve the mechanical transfer of a workpiece from one work station to another. In order to achieve this mechanical transfer with minimum error and maximum simplicity and reliability, the workpiece should be maintained in the same specific orientation throughout the entire series of sewing operations. Normally, this would require that the workpiece be securely clamped in place.

However, the structure of conventional sewing equipment requires that the workpiece be free to move throughout the entire stitching pattern. As a result, after each step in the stitching operation, the fabric workpiece must be released from the clamp, reoriented, and reclamped at the next sewing station. This complicates automated sewing operation, and the resulting complexities have been a major obstacle to automation of the manufacture of sewn articles.

One possible approach to solving the above problem is to create a sewing machine in which the needle moves with respect to the work, and in which the entire sewing apparatus is moved through the stitching pattern with the workpiece held steady. However, adapting a conventional sewing machine to do this produces severe limitations, for example, on sewing speed. As is well known, all industrial and other sewing machines incorporate a system of cranks and linkages to convert rotary motion of a drive shaft to the necessary reciprocating movements for driving a needle bar and thread takeup mechanisms. The high speeds that are required for industrial applications are accompanied by large inertial forces in these components. In order to overcome these inertial loads, a relatively massive supporting structure is required. Because accelerating the entire massive supporting structure through a stitching pattern at high speeds would create unmanageable forces, this approach could not be used at the stitching rates required for industrial operation.

Accordingly, it is an object of this invention to provide a sewing machine device in which the needle is moved through a desired stitching pattern while the workpiece is held stationary, but which can be made to operate at the high stitching rates required for industrial sewing operations.

It is another object of this invention to provide a sewing machine device as aforesaid in which the high inertial load portions of the device, such as the motor, the drive shaft, and the drive head for producing reciprocating drive motion to drive the needle bar of the device, are maintained stationary, while reciprocating action is transmitted to the needle bar and other required moving parts by means of a lightweight transmission medium, such as flexible housed cables.

It is yet another object of this invention to provide a sewing machine device, as aforesaid, having a reduced inertia such that programmed guiding means can be applied thereto for automatically controlling the device to follow a desired stitching pattern.

In a favorable embodiment as described herein, a stitch forming technique known in the art as "single needle rotary hook lock stitch" can be employed. This technique is well known to those skilled in the art of sewing machines. As its application to the present invention is straightforward, the details of the stitch forming elements are not described in detail.

According to a favorable embodiment of this invention, a sewing machine device comprises a base, a platform elevated above the base, and a column supporting the platform above the base. A stitching head assembly is suspended from the platform above the base. This stitching head assembly includes a frame, a needle bar mounted for vertical reciprocal movement of a stitching needle supported thereon, a clamp eye having an opening through which the needle passes and mounted for reciprocal vertical movement relative to the frame, and a thread take-up member mounted on the frame for relative movement towards and away from the needle bar. A stitching drive mechanism is mounted on the platform for imparting reciprocating motion to the needle bar. This mechanism includes a main shaft providing rotary drive motion and a drive head coupled to the main shaft for transforming the rotary motion to reciprocating motion. A rotary sewing hook is mounted below the frame on a hook shaft that is journalled in the frame for rotational motion. A bar pivotally attached to the platform suspends the hook shaft a predetermined distance below the platform, and journals the hook shaft for rotation, supporting the hook shaft for axial movement along the hook shaft axis and rotational movement about the axis of the suspending bar. A drive link mechanism, such as a timing belt and pulley arrangement, links the main shaft and the hook shaft so that the latter rotates synchronously in a two-to-one ratio with the main shaft. Flexible drive and support means, for example, housed flexible cables, suspend the stitching head a predetermined distance below the platform and also transmit the reciprocating motion from the driving head to the needle bar, the clamp eye, and the thread take-up member. An electrooptical synchronizing arrangement, which can be formed of an apertured disk mounted on the main shaft, and an associated light source and photodetector, can provide synchronizing pulses, once each revolution of the main shaft, to initiate a cycle of the drive mechanism for moving the frame relative to the work piece. Finally, X and Y reciprocating drive means move the stitching head through a predetermined stitching pattern in two dimensions relative to the base.

In a preferred embodiment, the stitching head frame is generally C-shaped, with an upper horizontal portion and a lower horizontal portion each having an end at an open end of the frame. The needle bar, the clamp eye, and the thread take-up eye are supported at the end of the upper horizontal portion, with the end of the lower horizontal portion having an aperture through which the needle can pass. The end of the lower horizontal portion also serves, in cooperation with the clamp eye, to hold the fabric workpiece to be stitched.

The above and many other objects, features, and advantages of this invention will be more fully understood from the ensuing detailed description of a preferred embodiment, when read in connection with the accompanying drawing, in which:

The sole drawing FIGURE is a perspective view of a preferred embodiment of this invention.

With reference to the sole drawing FIGURE, a programmable sewing machine 10 has a base 12 on which a column 14 rises to support a platform 16. A motor 18 mounted on the underside of the platform 16 is connected by a belt drive to a compressed-air driven clutch brake mechanism 20, which in turn drives a main shaft 22. The clutch brake mechanism 20, which is operative to stop with the associated needle bar in its upward position, can be of the type disclosed in U.S. Pat. No. 3,805,930, granted Apr. 23, 1974. Of course, the clutch-brake mechanism 20 can be of any other suitable type commonly employed in tacker-type sewing machines.

A stitching head 24 is formed of a U-shaped or C-shaped frame 26 having upper and lower members. A sewing hook 28 is mounted on one end of a hook shaft 30 which is journalled in the lower portion of the frame 26 and which passes through a through-clearance 32 in the column 14. A timing belt pulley 34 mounted on the end of the hook shaft 30 remote from the hook 28 is coupled by means of a timing belt 36 to a second timing belt pulley 38 mounted on the main shaft 22. The timing belt 36 ensures that the shafts 22 and 26 turn in synchronism. Also, as the belt 36 is mounted with a half twist, the main shaft 22 and hook shaft 28 turn in opposite directions.

Also mounted on the stitching head 24 at the upper horizontal portion of the frame 26 are a needle bar 40 on which is supported a sewing needle 42, a thread take-up eye 44, and a clamp eye 46. The thread take-up eye 44 is supported for generally vertical movement. An upper end 52 of the clamp eye 46 is slidably mounted on the tubular support 50 for vertical movement towards and away from the lower portion of the frame 26, for clamping and releasing a fabric workpiece (not shown). Also, the clamp eye 46 has a circular cutout through which the needle 42 can pass, as does the end of the lower horizontal portion of the frame 26.

First, second, and third housed flexible cables 54, 56, and 58 suspend the frame 26 a predetermined distance from the end of the platform 16. The cables 54, 56, and 58 are preferably of the "push-pull" type commonly used to transmit motion in various industrial mechanisms. These cables have flexible housings in which a core transmits motion relative to the housing. A driving head 60 on the platform 16 converts rotary motion of the main shaft 22 into reciprocating motion for driving the needle bar 40, the thread take-up 44 and the clamp eye 46.

A bar 62 is pivotally mounted on an underside of the platform 16 at the end thereof remote from the driving head 60 and the cables 54, 56, 58. This bar 62 is capable of swinging in the direction towards and away from the column 14, and is also free to rotate about its own axis. The hook shaft 30 is journalled in a bearing 64 permitting rotation of the hook shaft 30. The hook shaft 30 can be moved in the directions of the bar 62: that is, the hook shaft 30 can move generally in the axially direction of the hook 30, as shown by the arrow 66, and can be rotated about the axis of the bar 62, as shown by the curved arrow 68.

An X-reciprocal drive mechanism 70, which can include for example a servo motor or linear stepper motor arrangement, has a rod 72 pivotally connected to the stitching head frame 26. The drive mechanism 70 is controlled, for example, by numerical techniques, to move the rod 72 and the stitching head 24 in one horizontal direction, or "X" direction, as indicated by an arrow 74.

A Y-reciprocal drive mechanism 76, generally similar to the mechanism 70, has a rod 78 pivotally connected to the end of the suspending bar 62 to move the bar, and hence the hook shaft 30 and the frame 26, in the other horizontal direction, or "Y" direction, as generally indicated by the arrow 66.

A thread supply spool or cone 80 may be mounted at any convenient location on the machine. From the cone 80 the thread feeds through eyes and tensioning devices (not shown) to the take-up eye 44 and the needle 42. The details of the thread feeding means may take any form appropriate for single needle lock stitch machines.

An electro-optical syncronizer 90 includes a disk 92 arranged to rotate with the main shaft 22, a light transmitter 94, and a light receiver 96 arranged axially on either side of the disk 92 and aligned with each other. An aperture 98 in the disk 92 is aligned with the transmitter 94 and receiver 96 once per revolution of the shaft 22. Upon each such alignment, the receiver 96 provides an electric pulse, which is used to synchronize movement of the drive mechanism to move the stitching head 24 relative to the workpiece.

Here, the transmitter 94 can include a lamp or LED, and the receiver 96 can include a photodiode or phototransistor. Of course, other equivalent means can be employed for synchronizing the drive mechanism; for example, a magnetic system employing a hall sensor or a reed switch could be used.

A cycle of the sewing machine can employ the following steps: First, the clamp eye 46 lowers to clamp the fabric workpiece; second, the needle 42 descends and rises to form a stitch; third, the thread take-up eye 44 sets the stitch as the clamp eye 46 rises to free the work; fourth, the synchronizer 90 signals the workpiece driving mechanism to effect relative movement between the workpiece and the machine in preparation for the next stitch; and finally, the next stitching cycle is initiated.

As mentioned earlier, the X-reciprocal drive mechanism 70 and the Y-reciprocal drive mechanism 76 can be digitally controlled, e.g., by means of a suitably programmed microprocessor or by means of a small personal computer. For complex sewing operations, a so-called minicomputer can be employed, as its greater memory and computing capacity can control an entire line of these programmable machines 10.

It should be appreciated that the combined actions of the bar 62 and the housings of the cables 54, 56, and 58 constrain the stitching head 24 to movement through a spherically-shaped surface whose radius is defined by the length of the cables 54, 56, and 58. However, the column 14, the cables 54, 56, 58, and the bar 62 are preferably selected to be sufficiently long, relative to the sewing patterns, that the spherical surface can be considered an adequate approximation of a plane.

At the end of the stitching operation, it is desirable to cut the sewing thread and raise the clamp eye 46 in order to free the fabric workpiece. The motion for these functions can be carried out by means of an air cylinder (not shown) and transmitted to the stitching head 24, for example, by means of additional housed flexible cables.

An important advantage achieved by this invention is the minimal number of constraints on the form of holding or clamping devices needed for holding the fabric workpiece in place. Virtually any type of clamping means can be employed so long as the workpiece is suspended in place over the entire area of the desired stitching pattern. Accordingly, with this invention, a wide range of applications present themselves for operations involving automatic processing and transfer of fabric workpieces.

Conventional tacker type sewing machines are usually equipped with a device known as a clamp foot which grips the workpiece in order to drive it through its programmed stitch pattern. A secondary function of this clamp foot is to prevent so called "flagging", that is, the rising of the workpiece as the needle is withdrawn. This flagging can cause improper formation of the thread loop, which in turn can result in defective stitching. In order to prevent flagging, the clamp foot must grip the workpiece in close proximity to the point of stitching. This requires the clamp foot to conform to the shape of the stitch pattern. Thus, a specially constructed clamp foot must be provided for each different size or shape of pattern desired. In contrast to the conventional devices, in the embodiment described hereinabove, the sewing machine 10 employs the reciprocating clamp eye 46 having an annular cutout concentric with the needle. This clamp eye 46 is suitable for any arbitrary stitching pattern. When the needle is out of the workpiece, the clamp eye is raised to permit feeding motion of the stitching head 24 relative to the workpiece, but is lowered to the clamping position before the needle 44 enters the workpiece, and remains in its lowered position until after the needle 44 is raised from the workpiece, thereby eliminating flagging.

Other advantages of the sewing machine according to this invention include ease of maintenance owing to the spatial separation of the motion-generating and stitching portions of the apparatus; the elimination of thread wipers; simplified stopping and starting mechanisms; simplified thread cutting operation; and the provision of a generally open space around the stitching head. The last-mentioned feature facilitates the incorporation of such functions as edge sensing for closed-loop stitch guidance, or other various work manipulating mechanisms.

Terms of orientation as used in this specification and in the claims, such as "horizontal", "vertical", "above", etc., are intended for purposes of illustration with reference to the drawing FIGURE, and not to limit the scope of the invention, as devices employing the principles of this invention can be configured in any arbitrary orientation, as needed.

Of course, the preferred embodiment described hereinabove is given for purposes of illustration only. It is to be recognized that the invention is not limited to that precise embodiment, and that various changes and modifications may be effected therein by those skilled in the art without departure from the scope or spirit of this invention.

What is claimed is:

1. Sewing machine device comprising a base; a stitching head assembly suspended above said base for movement in two horizontal dimensions, the stitching head assembly including a frame, a needle bar mounted for vertical reciprocal movement and supporting a stitching needle, and a clamp foot for clamping a workpiece to said frame during a stitching movement of said needle; stitching drive means mounted at a position on said device apart from said stitching head assembly for generating reciprocating motion to be imparted to said needle bar and said guide foot; flexible drive and support means for suspending said stitching head a predetermined distance above said base and transmitting said reciprocating motion from said stitching drive means to said needle bar and said clamp foot; and stitching head driving means for moving said stitching head, relative to said base, through a stitching pattern in said two horizontal dimensions.

2. Sewing machine device according to claim 1, wherein said flexible drive and support means includes a plurality of housed flexible cables having an upper end connected to a point above said base and another end connected to the stitching head assembly frame, for transmitting reciprocating motion from said stitching drive means to said needle bar and said guide foot, respectively.

3. Sewing machine device comprising a base; a platform elevated above said base; means supporting said platform above said base; a stitching head assembly suspended from said platform above said base, said stitching head assembly including a frame, a needle bar mounted for vertical reciprocal movement and supporting a stitching needle, clamp means for reciprocal vertical movement relative to said frame for clamping a workpiece relative to said frame while said needle bar moves vertically, and a thread take-up member mounted on said frame for taking up a stitch in said workpiece; stitching drive means mounted on said platform for imparting reciprocating motion to said needle bar and including a main shaft providing rotary drive motion and a drive head coupled to said main shaft for transforming said rotary motion to reciprocating motion; a rotary sewing hook mounted below said frame; a hook shaft journalled in said frame and connected at one end to said sewing hook for rotationally driving the same; suspending means pivotally attached to said platform and journalling said hook shaft at a location remote from said one end for suspending said hook shaft a predetermined distance below said platform; drive link means coupling said main shaft and said hook shaft so that the latter rotates synchronously with the main shaft; flexible drive and support means for suspending said stitching head a predetermined distance below said platform and for transmitting said reciprocating motion from said driving head to said needle bar, said clamp means, and said thread take-up member; and stitching head driving means for moving said stitching head, relative to said base, through a stitching pattern in two dimensions.

4. Sewing machine drive according to claim 3, wherein said stitching head frame is generally C-shaped, with an upper and a lower horizontal portion each having an end at an open end of the frame, said needle bar, said clamp means, and said thread take-up bar being supported at the end of the upper horizontal portion, and the end of the lower horizontal portion having an aperture through which the needle can pass and serving with the clamp means to hold a fabric workpiece to be stitched.

5. Sewing machine device according to claim 3, wherein said suspending means includes a suspending bar pivotally attached at one end thereof to said platform, and having means at a lower end thereof journalling said hook shaft, said lower end being susceptible to motion in the direction along said hook shaft and in the rotational direction about the axis of the suspending bar.

6. Sewing machine device according to claim 3, wherein said stitching head driving means includes a reciprocating drive unit coupled to the lower end of said suspending bar for displacing said bar, and with it the hook shaft and the stitching head, at least in the direction along said hook shaft.

7. Sewing machine device according to claim 3, wherein said drive link means includes a first wheel mounted to rotate with said main shaft, a second wheel mounted on one end of said hook shaft, and a timing belt driving the second wheel in response to rotation of the first wheel.

8. Sewing machine device according to claim 3, wherein said flexible drive and support means includes first, second, and third housed flexible cables each having a flexible housing connected at one end to said platform and at another end to said stitching head, and a core member imparting said reciprocal movement from said drive head to said needle bar, said clamp means, and said thread take-up member, respectively.

9. Sewing machine device according to claim 3, wherein said stitching head drive means includes at least one reciprocating drive unit coupled to said stitching head for displacing the latter at least in a direction generally perpendicular to said hook shaft and generally parallel to said base.

10. Sewing machine device comprising a base; a platform elevated above said base; means supporting said platform above said base; a stitching head assembly suspended from said platform above said base, said stitching head assembly including a frame, a needle bar mounted for vertical reciprocal movement and supporting a stitching needle, a clamp eye having an opening through which said needle passes and mounted for reciprocal vertical movement relative to said frame, and a thread take-up means mounted on said frame for taking up a stitch effected by said needle; stitching drive means mounted on said platform for imparting reciprocating motion to said needle bar and including a main shaft providing rotary drive motion and a drive head coupled to said main shaft for transforming said rotary motion to reciprocating motion; a rotary sewing hook mounted below said frame; hook shaft means journalled in said frame for rotational motion and connected at one end to said sewing hook; suspending means pivotally attached to said platform and journalling said hook shaft means at a location remote from said one end for suspending said hook shaft a predetermined distance below said platform; drive link means coupling said main shaft and said hook shaft so that the sewing hook rotates synchronously with the main shaft; flexible drive and support means for suspending said stitching head a predetermined distance below said platform and for transmitting said reciprocating motion from said driving head to said needle bar, said clamp eye, and said thread take-up means; and stitching head driving means for moving said stitching head, relative to said base, through a stitching pattern in two dimensions.

11. Sewing machine device according to claim 10, wherein said clamp eye is formed of a clamp foot having an upper portion slidably mounted on said frame, and an annular eye portion coaxial with said stitching needle.

12. Sewing machine device according to claim 11, wherein said stitching frame is generally C-shaped, with an upper and a lower horizontal portion each having an end at an open end of the frame, said clamp foot being slidably mounted at the end of the upper horizontal portion, and the end of the lower horizontal portion having an aperture therethrough through which the needle can pass and serving with the eye portion of the clamp foot to hold a fabric workpiece while said needle moves therethrough.

* * * * *